US005627633A

United States Patent [19]

Hoffmann et al.

[11] Patent Number: 5,627,633

[45] Date of Patent: May 6, 1997

[54] PNEUMATIC BRAKING DEVICE FOR A RECORDING SUBSTRATE

[75] Inventors: Joachim Hoffmann, München; Edmund Creutzmann, Markt Schwaben; Walter Kopp, Taufkirchen; Helmut Berger, Fürstenfeldbruck, all of Germany

[73] Assignee: Siemens Nixdorf Informationssysteme Aktiengesellschaft, Paderborn, Germany

[21] Appl. No.: 424,429

[22] PCT Filed: Jul. 16, 1993

[86] PCT No.: PCT/DE93/00632

§ 371 Date: Apr. 21, 1995

§ 102(e) Date: Apr. 21, 1995

[87] PCT Pub. No.: WO94/09408

PCT Pub. Date: Apr. 28, 1994

[30] Foreign Application Priority Data

Oct. 22, 1992 [DE] Germany ..... 42 35 705.5

[51] Int. Cl.[6] ..... G03G 15/20

[52] U.S. Cl. ..... 399/322

[58] Field of Search ..... 355/282, 312, 355/285, 73, 72; 137/625.41; 271/183; 269/20, 21

[56] References Cited

U.S. PATENT DOCUMENTS

| | | | |
|---|---|---|---|
| 1,728,329 | 9/1929 | Broadmeyer | 271/251 |
| 2,911,008 | 11/1959 | DuBois | 137/625.41 X |
| 4,147,922 | 4/1979 | Naeser et al. | 219/216 |
| 4,173,301 | 11/1979 | Turini et al. | 226/102 |
| 5,058,876 | 10/1991 | Grossmann | 355/312 X |

FOREIGN PATENT DOCUMENTS

| | | |
|---|---|---|
| 0340135 | 11/1989 | European Pat. Off. . |
| 63-292177 | 11/1988 | Japan . |

OTHER PUBLICATIONS

*Patent Abstracts of Japan*, vol. 3, No. 001, 11 Jan. 1979, "Conveyor For Continuous Paper", Hitotsubashi Hiroo.

*Patent Abstracts of Japan*, vol. 7, No. 109, 12 May 1983, "Detection for Clogging of Filters", Riyuuichi Kamei.

*Patent Abstracts of Japan*, vol. 007, No. 200, 3 Sep. 1983, "Manufacturing Device of Semiconductor", Kanai Norio et al.

*Patent Abstracts of Japan*, vol. 14, No. 179, 10 Apr. 1990, "Fixing Device for Laser Beam Printer", Sugaya Tomio.

*Primary Examiner*—Matthew S. Smith
*Assistant Examiner*—Quana Grainger
*Attorney, Agent, or Firm*—Hill, Steadman & Simpson

[57] ABSTRACT

An electrographic printing or copying machine contains, by way of example, a preheating saddle (20,21) positioned upstream of a pair of fixing rollers in the recording substrate running direction and a braking element (10). The preheating saddle (20,21) and braking elements (10) form a gliding surface (23). Suction openings (18,19) in fluid communication with a vacuum-generating device ensure good contact between gliding surface (23) and recording substrate. With the aid of a valve (1), the vacuum can be matched to the operating parameters of the printing and copying machine, or to the parameters of the recording substrate.

20 Claims, 3 Drawing Sheets

PNEUMATIC BRAKING DEVICE FOR A RECORDING SUBSTRATE

BACKGROUND OF THE INVENTION

The present invention generally relates to electrographic imaging machines, such as printers and copiers. More particularly, the present invention relates to a braking device for a recording medium to halt a sheet recording medium or substrate along its transport path.

Pneumatic braking devices for a recording substrate are used in electrographic printing or copying machines. The recording a mediums or recording substrates used in these machines typically are paper or plastic films in single-sheet or web form. On their path through the electrographic printing or copying machine, the recording substrates are transported between transport rollers over gliding surfaces. In some cases it is necessary to brake the recording substrate on the gliding surfaces and to smooth it in cooperation with the transport rollers. At such locations, suction openings are provided in the gliding surfaces and are coupled to a vacuum-generating device.

An example of such an application is the fixing device of an electrographic printing or copying machine. There, a recording substrate provided with toner images must run through a fixing station. In so doing, the toner image is melted into the recording substrate. Such a fixing station, known for example from U.S. Pat. No. 4,147,922 or JP-Abstract Vo. 13, No. 120, Mar. 24th, 1989 (JP-A-63-292177), can comprise two rollers—a fixing roller and a nip roller—of which at least one is heated and one is motor-driven, and a preheating device, for example a heatable saddle, arranged in front of the rollers. The satisfactory functioning of the fixing process requires that the recording substrate rests closely on the preheating saddle. For this purpose, the recording substrate must be tensioned over the saddle. In order to achieve this, a braking device can be provided in of the saddle, seen in the movement direction of the recording substrate.

The pneumatic braking device has, in such applications, the advantage that the recording substrate is sucked onto the gliding surface of the braking element of the braking device for braking and hence the braking device engages on only one side of the recording substrate. The other side of the recording substrate, for example the side of the recording substrate on which the toner images are arranged, is not impaired by the braking device.

From U.S. Pat. No. 4,172,301, a measure is known to match the suction width of the gliding surface to a parameter, specifically the width of the recording substrate. This reference is incorporated herein by reference in its entirety. In this arrangement, in accordance with the width of the recording substrate, specific suction openings in the gliding surface are closed, while the suction openings located in the region of the recording substrate remain opened. By means of this measure it is ensured that the fixedly set value of the vacuum, which is generated with the aid of the vacuum-generating device, can be maintained in the case of different recording substrate widths. Further measures involving the vacuum are not provided.

Patent Abstracts of Japan, Vol. 14, No. 179 (p-1034) & JP,A,02 028 677 disclose a fixing device having pneumatic braking element and preheating saddle of a printing or copying machine. The suction air in the suction openings of the preheating saddle can be switched off by means of valves. Switching off the suction air is carried out in an operating condition of the printing or copying machine in which no recording substrate transport is taking place. As a result, the recording substrate lifts off from the preheating saddle. Warping of the recording substrate in this operating condition is prevented. A possibility of varying the vacuum as a function of parameters of the recording substrate is not provided.

With reference to the gliding surface of the preheating saddle of a fixing device, special problems arise. In the known fixing devices, it has previously been assumed that it is necessary to preheat the recording substrate, comprising paper as a rule, very rapidly over a relatively short path with the aid of the preheating paddle and then to fix the toner image on the recording substrate via the rollers. However, it has been proved that a rapid heating up of the recording substrate over a short path leads to a high loading of the recording substrate. This loading is expressed in a deformation, a warping or an ageing of the recording substrate. Recording substrates comprising paper also exhibit a non-uniform loss of water during the passage through the fixing station. Hence, post-processing of the recording substrate by cutting or sorting is made more difficult or a non-uniform fixing of the toner images and thus an impairment of the quality of the print occurs.

Remedies can be supplied by slowing down the heating up of the recording substrate. However, a necessary lengthening of the preheating saddle is associated with a slowing down of the heating up in the case of a constant printing speed. In the case of this lengthening of the preheating saddle it is essential to ensure good thermal transfer between recording substrate and the saddle gliding surface. Good thermal transfer is only achieved if direct contact can be produced between recording substrate and saddle gliding surface. At high printing speeds and in the use of pre-folded recording substrates or those of non-uniform thickness, fluttering movements of the recording substrate can occur in the region of the saddle. As a consequence, the recording substrate lifts partially off from the saddle, and this impairs the thermal transfer.

Endless paper printers, in particular, must be able to process an extremely large spectrum of recording substrates in paper form. The recording substrate has, for example, a paper basis weight (grammage) of 50 $g/m^2$ to 160 $g/m^2$. Coated and uncoated papers, recycled papers, plastic-coated papers, and long-fibered and short-fibered papers are processed. In addition, every year grades of paper with new properties come onto the market, which must be processed by the printing or copying machines in an optimal manner without hardware change.

The material of the recording substrate contains various components which are released on heating. The components released in the form of vapor or gas are precipitated in the printing or copying machine and cause disturbances there. In the heating of paper, for example, steam is released which can cause corrosion.

SUMMARY OF THE INVENTION

It is an object of the invention to provide pneumatic braking device of the type mentioned at the beginning in such a way that the pneumatic braking device is enabled to handle recording substrates of the most different parameters, such as width, thickness and finish securely and reliably.

It is a further object to provide a pneumatic braking device for a recording substrate in a printing or copying machine and allocated to a fixing device in such a way that it is possible to match the effectiveness of the pneumatic braking device to the operating parameters, such as for example fixing temperature, recording substrate transport speed, and to the recording-substrate-specific parameters, such as width, thickness and finish, in such a way that a high fixing quality is achieved with reliable handling of the recording substrate.

Arranged in the gliding surface is at least one suction opening. This suction opening has an effect at least on the region of the gliding surface which comes into contact with the recording substrate. Therefore, slot-shaped depressions led longitudinally or transversely can be provided in the gliding surface, and end in the suction openings. If a plurality of suction openings are provided, one or more slot-shaped depressions can be allocated to one or more suction openings. If so many suction openings are provided that the entire region of the gliding surface can be influenced thereby, the slot-shaped depressions can be completely omitted. The suction openings are coupled to the vacuum-generating device. This coupling can be carried out by hoses, by channels or by direct flanging of the vacuum-producing device onto the suction openings. The air delivery quantity of the vacuum-producing device can be controlled using means for adjusting the vacuum. A blower which can be set in terms of its rotational speed, a valve connected between the blower and suction openings, throttle valves and the like are suitable as said means. These means can be manually or automatically matched to the parameters of the recording substrate. For this purpose, an arrangement for setting the vacuum is provided. If this arrangement is of the manual type, it can, for example, comprise a lever which can be brought into various rotational positions, each of which is allocated to a specific recording substrate and its parameters. An automatic setting can, for example, be carried out by means of an electromagnetic or electric motor drive of the means for adjustment, a control unit being provided for this drive and controlling the electromagnet or electric motor on the basis of parameters of the recording substrate fed to it in such a way that the desired vacuum results.

If the pneumatic braking device is allocated to a fixing device, its gliding surface then comprises a saddle gliding surface allocated to the preheating saddle and a braking gliding surface allocated to the braking element. The braking element in this arrangement serves for tautening the recording substrate before the fixing process. The formation of creases and folds in the recording substrate is avoided.

The preheating saddle following the braking element in the recording substrate running direction heats the recording substrate such that an optimal fixing result can be achieved. In order to produce an optimum contact between the gliding surface in the region of the preheating saddle and the recording substrate, the gliding surface in the region of the preheating saddle is radially shaped.

This radial shaping ensures a force component, which presses the recording substrate against the saddle gliding surface, over the entire saddle length. This force component is additionally supported by the suction openings in the saddle gliding surface. It is also ensured here that, via slot-shaped depressions or via a sufficient number of suction openings, the recording substrate is influenced in its entire extent located over the saddle gliding surfaces by the suction effect of the vacuum-generating device. As a consequence, a good contact is additionally produced between recording substrate and gliding surface. This good contact is achieved irrespective of operating parameters such as the printing speed, fixing temperature etc., and the parameters of the recording substrate.

Contributing to a decisive extent to this result are the means for adjusting the vacuum and the arrangement which registers the operating parameters and/or the parameters of the recording substrate and drives the means as a function thereof. Only by this means is it possible to carry out each printing or copying commission individually and reliably, although different recording substrates are processed.

Of particular advantage is the use of a valve as means for adjusting the vacuum, the valve being arranged between the vacuum-generating device and the suction opening or openings. With the aid of the valve it is possible to adjust the vacuum within the shortest time or to disconnect the vacuum-generating device from the suction openings. The design of the valve with a valve channel and a rotary piston arranged in the valve channel and, in the event of its rotation, influencing an effective valve channel cross-sectional area of the valve channel, the rotary piston having a cross-sectional shape which is determined in such a way that during a rotation of the rotary piston the vacuum is changed approximately linearly with respect to the angle of rotation, makes it possible to control the valve particularly simply.

The cross-sectional shape of the rotary piston has, in accordance with a particular design, in its section located in the valve channel a cross section which contains at least one flat or depression. In addition, the cross section of the valve channel in the region of the rotary piston is shaped in such a manner that, during rotation of the rotary piston, the effective valve channel cross-sectional area of the valve channel has, in a first angular section, the shape of a rectangle standing on its narrow side, in a second angular section the shape of a trapezoid and, in a third angular section, the shape of a rectangle standing on its broad side. The short side of the trapezoid in this arrangement is directly connected to a narrow side of the first-named rectangle and the long side of the trapezoid is directly connected to a broad side of the second-named rectangle. The linear dependence of the vacuum on the angle of rotation is achieved by means of the cross section thus designed of the valve channel and of the rotary piston.

The valve channel has, in the region of the rotary piston, an opening to the environment. With the aid of the rotary piston, a connection of the suction openings to the environment or to the vacuum-generating device can thereby be optionally switched. This switching over can be carried out in the shortest time. This is especially necessary if the printing operation is interrupted or the recording substrate transport direction is changed.

The arrangement for setting the vacuum has a parameter acquisition unit, with the aid of which the recording-substrate specific data can be acquired. This data acquisition can be carried out manually by means of keyboard entry, semi-automatically by means of a bar code reading wand or fully automatically by means of a bar code reading device which is arranged in the printing or copying machine in such a way that it can read a bar code applied to the recording substrate or to a packaging of this recording substrate. Allocated to the arrangement for setting the vacuum are, furthermore, a motor coupled to the rotary piston, position sensors arranged in the environment of the rotary piston and allocated in each case to one rotary position and a control unit coupled to the components of the arrangement for setting the vacuum. The control unit is capable of controlling the motor in such a way that the rotary piston achieves a rotary position associated with the acquired parameters and located between or on the rotary positions marked by means of the position sensors.

Between the valve and the suction openings, a pressure sensor is provided, which is coupled to the control unit. With the aid of this pressure sensor, the control unit is able to acquire the actual vacuum actually achieved and to compare it with the desired vacuum allocated to the acquired parameters. If an inequality appears, the control unit can drive the motor in a corresponding manner such that actual vacuum and desired vacuum are identical.

The preheating saddle has a plurality of heating zones with temperature increasing in the recording substrate running direction. In consequence, a uniform energy feed to the recording substrate is achieved, as a result of which the recording substrate is loaded only lightly. For increasing the contact of the recording substrate with the saddle gliding surface, the saddle gliding surface is convexly curved in the recording substrate running direction. On the side of the preheating saddle opposite the saddle gliding surface, provision is made of at least one vacuum channel in the recording substrate running direction. A multiplicity of suction openings open into this vacuum channel. The vacuum channel can be arranged on the saddle edge or in any possible intermediate position between the two edges. The number of the vacuum channels is matched to the necessary air supply capacity. The suction openings open in slot-shaped depressions in the saddle gliding surface which extend transversely to the recording substrate running direction. By this means it is achieved that the recording substrate is sucked onto the saddle surface not only in a point-like manner, but over a large area. The slot-shaped depressions in this arrangement can be straight or curved and can likewise extend parallel to each other or have nonuniform spacings from each other along their extent.

The valve is coupled directly to the braking element, while the vacuum channels are coupled indirectly to the valve via the braking element. By means of this arrangement, conclusions can be drawn from the vacuum prevailing in the braking element as to the vacuum in the vacuum channels. As a consequence, it is sufficient to determine the desired vacuum in the braking element with the aid of the pressure sensor, in order to fix the actual vacuum both in the braking element and in the vacuum channels. In addition, a matching device provided in the braking element for matching the effective width of the braking element to the actual width of the recording substrate can additionally be used for opening or closing vacuum channels.

The vacuum-generating device contains an air filter, which protects the printing or copying machine from contaminants which are suctioned up from the recording substrates. With increasing contamination of the air filter, the air supply capacity of the vacuum-generating device decreases. In accordance with the reduction of supply capacity, the control unit increases the effective valve channel cross-sectional area. On reaching the maximum valve channel cross-sectional area, the control unit causes a signal in accordance with which the filter of the vacuum-generating device must be cleaned or exchanged.

A further essential aspect of the suctioning of the recording substrate onto the saddle surface, apart from the optimization of the thermal transfer between preheating saddle and recording substrate, is the sucking off of gases and vapors being released during the heating of the recording substrate. Damaging influences of these gases and vapors within the printing or copying machine are prevented.

Additional features and advantages of the present invention are described in, and will be apparent from, the detailed description of the presently preferred embodiments and from the drawings.

DESCRIPTION OF THE DRAWINGS

Embodiments of the invention are represented in the drawings and are described in more detail by way of example in the following test. In the drawings.

DETAILED DESCRIPTION OF THE PRESENTLY PREFERRED EMBODIMENTS

An electrographic printing or copying machine for printing recording substrates in the form of individual sheets or endless paper contains a fixing device. This fixing device is designed as a thermoprinting fixing device. The thermoprinting fixing device essentially contains a heating roller and a nip roller (not shown) and a preheating saddle (20,21). The heating roller is driven by an electric motor, so that the recording substrate located between nip roller and heating roller is transported in a recording substrate running direction 9.

Figure 1:
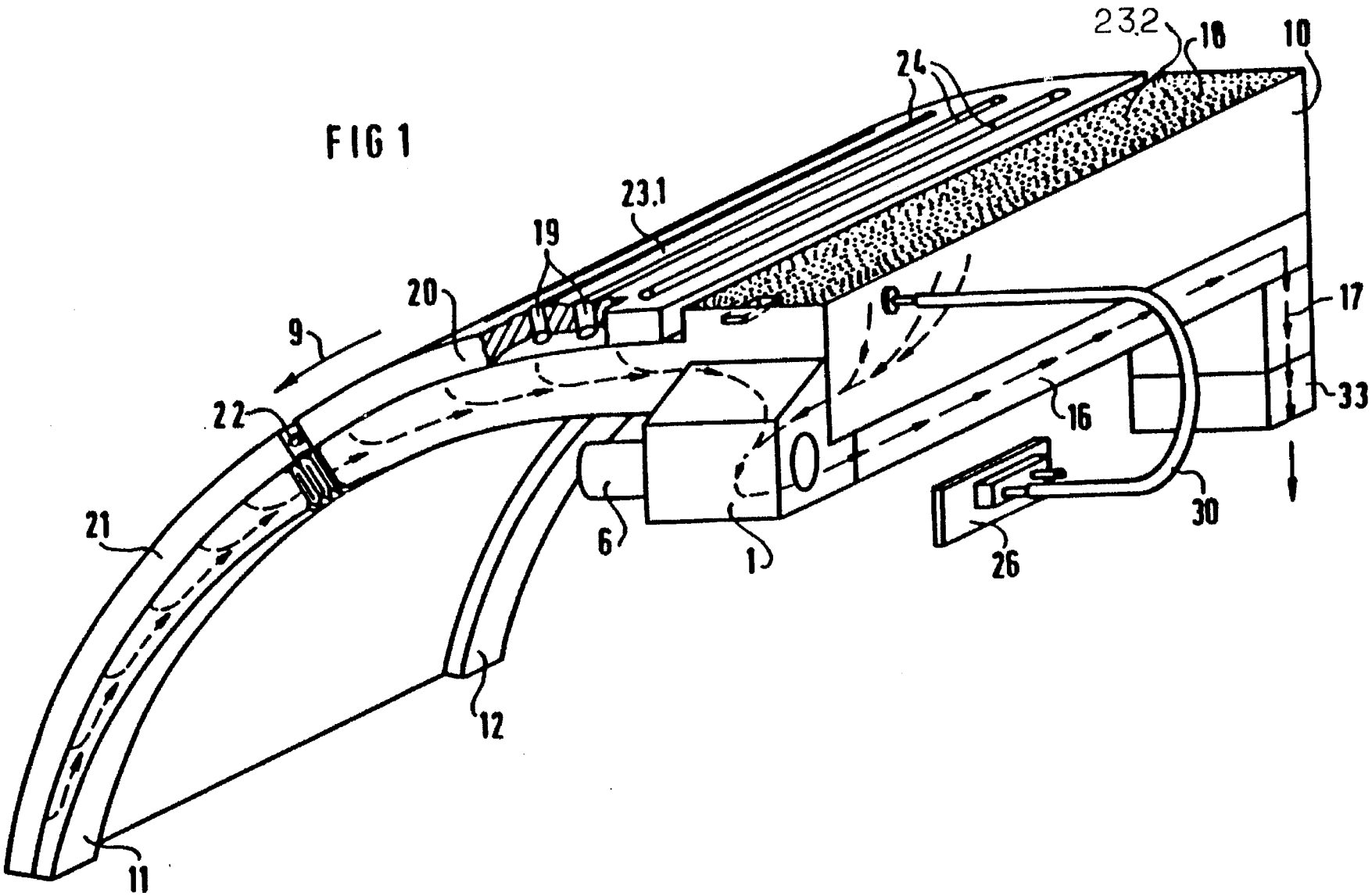
FIG. 1 shows a schematic representation of a pneumatic braking device, comprising a preheating saddle allocated to a fixing device and having suction openings, upstream of which a braking element is positioned.

A braking element 10 is positioned upstream, in the recording substrate running direction 9, of the fixing device in accordance with FIG. 1. The surface of the braking element 10 forms a braking gliding surface 23.2 and the surface of the preheating saddle, composed of a first preheating saddle 20 and a succeeding second preheating saddle 21, forms a saddle gliding surface 23.1. Saddle gliding surface 23.1 and braking gliding surface 23.2 form the gliding surface 23, over which the recording substrate is drawn. The heated preheating saddle 20, 21 is shaped radially and serves to preheat the recording substrate. The latter is fed, in the preheated condition, to the actual fixing gap between the nip roller and the heating roller. Braked by the braking element 10 and driven by the rollers, the recording substrate is guided tautly over the preheating saddle 20, 21. A loose toner image located on the recording substrate is preheated on the preheating saddle 20, 21 and is fixed on the recording substrate by means of heat and pressure between the rollers.

The two heated preheating saddles 20, 21, connected one after the other in the recording substrate running direction, are connected to each other so as to be pivotable about a point of rotation 22. The first preheating saddle 20 and the second preheating saddle 21 form two separate heating zones, seen in the recording substrate running direction 9. The entire preheating path in this arrangement has a length of approximately 500 to 700 mm. The recording substrate, during preheating, glides with its toner-free side on the gliding surface 23.

In order to produce a good contact between the saddle gliding surface 23.1 and the recording substrate, and thus to keep the temperature difference small, the saddle gliding surface 23.1 has a radius which is 700 mm in the example shown. As a result of the curvature of the saddle gliding surface 23.1 in conjunction with the tension caused by the rollers, and of the braking caused by the braking element 10, a force component which presses the recording substrate onto the saddle gliding surface 23.1 acts over the entire saddle length.

Furthermore, as can be seen in FIG. 1, the saddle gliding surface 23.1 has, transverse to the recording substrate running direction 9, elongated slot-shaped depressions 24 which are led parallel to each other and which extend approximately over the entire width of the preheating saddle 20,21. The slot-shaped depressions 24 are connected, by means of suction openings 19 designed as lateral holes, to vacuum channels 11,12 arranged on both sides underneath the preheating saddle 20,21. The vacuum channels 11,12 extend in the recording substrate running direction 9. Their end facing the fixing device is closed. The other end opens in the braking element 10.

The braking element 10 is designed as a hollow body. Its side facing towards the recording substrate forms, together with the preheating saddles 20,21, the gliding surface 23. A multiplicity of suction openings 18 in the form of holes is introduced from the braking gliding surface 23.2 into the hollow space of the braking element 10.

Seen in the recording substrate running direction 9, a valve 1 is flanged on the braking element 10. The valve 1 is connected to a blower 17 via a blower channel 16. Using the valve 1, the vacuum generated by the blower 17 can be matched to the operating parameters present in the printing or copying machine. The operating parameters include recording-substrate-specific parameters such as width, thickness and finish, as well as fixing temperature, standby operation etc.

Extending the suction effect over the entire gliding surface 23, that is to say also over the region of the preheating saddle 20,21, makes possible not only a reliable nestling of the recording substrate against the gliding surface 23 in the region of the preheating saddle 20,21, but also a suctioning away of a gas released during the heating of the recording substrate. If paper is used as recording substrate, steam is released during the heating and, if it is not sucked away, can lead to corrosion within the printing or copying machine.

The printing or copying machine is intended to be able to process a multiplicity of recording substrates. In order to prevent fluttering, tearing and creasing of the recording substrate, the vacuum can be varied with the aid of the valve 1. A further adjustment capability can be provided, in order to improve a matching to different recording substrate widths. In the event of using a narrow recording substrate, the suction openings 18,19 located further removed from the valve 1 are no longer covered by the recording substrate. The suction effect on the recording substrate is reduced thereby. In U.S. Pat. No. 4,173,301, it is indicated how suction openings 18 which are not needed can be closed by means of a slide or by means of pinhole diaphragms. Such devices can also be included in the subject matter of the invention. In addition, flaps, slides or pinhole diaphragms can be provided which, if required, close on the braking element side one of the two vacuum channels 11,12 opening into the braking element 10.

The valve 1, serving as means for adjusting the vacuum, is coupled to an arrangement which acquires operating parameters of the printing or copying machine and/or parameters of the recording substrate and drives the valve as a function thereof. The valve 1 can be adjusted using a motor 6. The motor 6 is, in accordance with FIG. 2, driven by a control unit 25. The control unit 25 has various inputs 28, 29, 34.

Figure 2:
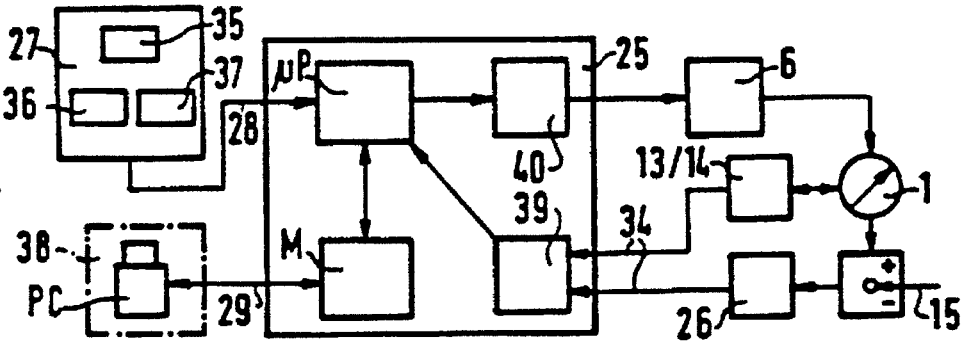
FIG. 2 shows a block schematic diagram of an arrangement for setting the vacuum in a pneumatic braking device in accordance with FIG. 1.

A parameter acquisition unit 27 is coupled to a first input 28. The components of the parameter acquisition unit 27 are represented in FIG. 2 in the form of blocks. The parameter acquisition unit 27 serves in this example for acquiring the parameters of the recording substrate. The parameter acquisition unit 27 can, however, be designed in any desired fashion, so that it can also be used for acquiring and selecting operating parameters, such as for example fixing energy, printing speed, printing operation in general, standby operation etc. The recording-substrate-specific characteristic data, such as paper basis weight, paper grade or other data characterizing the structure of the recording substrate can be acquired in order to be able to derive therefrom desired control values for the vacuum.

A significant item of recording-substrate-specific characteristic data is, in particular, the paper basis weight. This can be acquired and entered in the following manner:

a) Manual entry of the paper basis weight: The parameter acquisition unit 27 can have allocated to it a keyboard 35, via which the paper basis weight can be entered alphanumerically. The paper basis weight is, as a rule, printed on the recording substrate packaging.

b) Semi-automatic entry of the paper basis weight: The parameter acquisition unit 27 can have assigned to it a code reading wand 36, via which an operator acquires a bar code printed on the packaging of the recording substrate and enters the necessary information in this manner.

c) Automatic entry of the paper basis weight: c1) If, for example, a bar code is printed on the bottom of the packaging of the recording substrate, an automatic bar code or OCR-reading device 36 can be arranged in the region of the receiving platform for the recording substrate in the printer, the said reading device automatically acquiring the data printed on the packaging of the recording substrate. c2) The paper thickness is proportional to the paper basis weight. It is therefore possible to determine the paper basis weight by means of acquiring the paper thickness. The parameter acquisition unit 27 can therefore be connected to a thickness measuring device 37, with which it is possible to acquire the paper thickness. This device can, for example, comprise a measuring device which acquires the paper thickness optically, mechanically or capacitively. Measuring devices of this type for acquiring the material thickness are known in measurement technology. They can comprise, for example, two sensing elements between which the paper is arranged, a thickness-dependent path change of the measurement path being acquired inductively, capacitively or via strain gauges. A device of this type, acquiring the paper thickness, can be provided in the paper inlet region of the printing device.

The control unit 25 is connected to an additional entry arrangement 38 via a second input 29. The additional entry arrangement 38 can be implemented in the form of a personal computer PC. With the aid of the additional entry device 38, algorithms or tables for determining the desired vacuum can be constructed or changed and subsequently stored in a memory M contained in the control unit 25. This is always necessary when no desired vacuum appertaining to a paper basis weight is known or can be calculated, or a known desired vacuum appears to be faulty.

Via a third input 34, a pressure sensor 26 and two position sensors 13, 14 are coupled to the control device 25. These sensors supply the control units 25 with information about the rotational position in which the rotary piston 3 is located and about which vacuum prevails.

As central element, the control unit 25 contains a microprocessor μP which evaluates the information supplied by the parameter acquisition unit 27 and the sensors 13, 14, 16 and drives the motor 6 as a function of this information.

For driving the motor 6, the control unit has a power block 40. The power block 40 can, for example, be a D/A converter, whose output driver is designed such that it supplies sufficient power to drive the motor 6.

The sensors 13, 14, 26 supply their information via the third input 34 to a converter block 39 contained in the control unit. The converter block 39 is equipped, for example by means of an A/D, converter with input driver stages matched to the sensors. The converter block 39 converts the analog sensor information into digital information which can be processed by the micro processor μP.

The control unit 25 further contains the memory M. The microprocessor μP is connected directly to the memory M. Stored in the memory M are tables or algorithms with the aid of which the microprocessor μP determines the desired vacuum from the data supplied by the parameter acquisition unit 27, specifically the paper basis weight. With the aid of the algorithms, the microprocessor μP calculates the desired vacuum. With the aid of the tables, the microprocessor μP reads out of individual memory cells of the tables the desired vacuum allocated to the paper basis weight. The desired vacuum is stored in a memory cell and is compared with an actual vacuum supplied by the pressure sensor 26 (see FIG. 1).

A deviation of the actual vacuum from the desired vacuum results from a disturbance variable 15. The disturbance variable 15 symbolizes, by way of example, influences which result from deviations of the paper width, the paper surface finish or a varying printing speed. The pressure sensor 26 is connected to the braking element 10 via a hose 30. By using the hose 30, it is possible to arrange the pressure sensor 26 at any desired location within the printing or copying machine.

Figure 3:
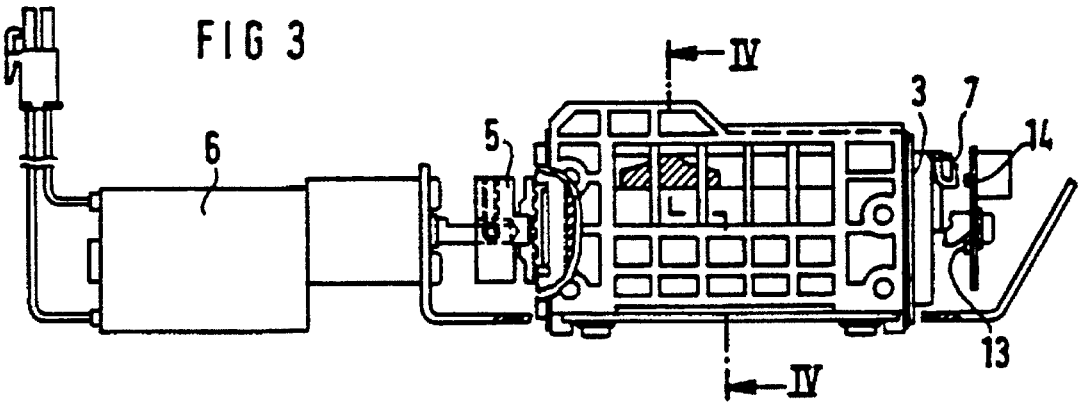
FIG. 3 shows a view of the side of a valve which is allocated to the pneumatic braking device, which side can be connected to the suction openings.
Figure 4A:
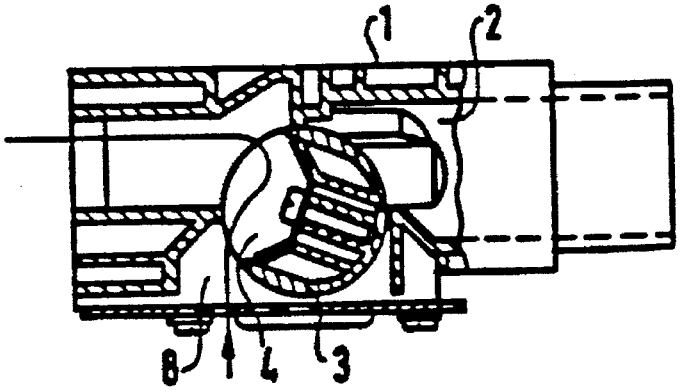
FIGS. 4A, 4B and 4C show a sectional representation of the valve sectioned along the section line specified in FIG. 3, with various rotational positions of a rotary piston arranged in the valve.
Figure 4B:
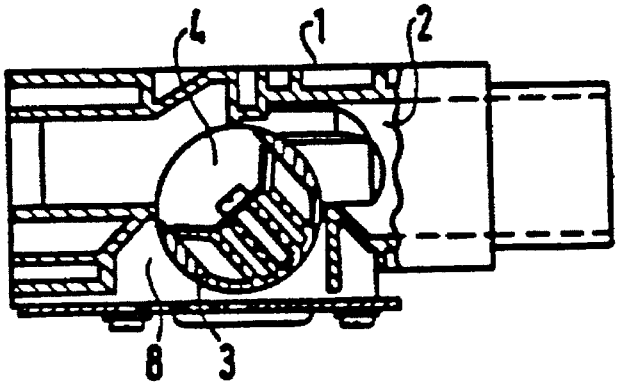
Figure 4C:
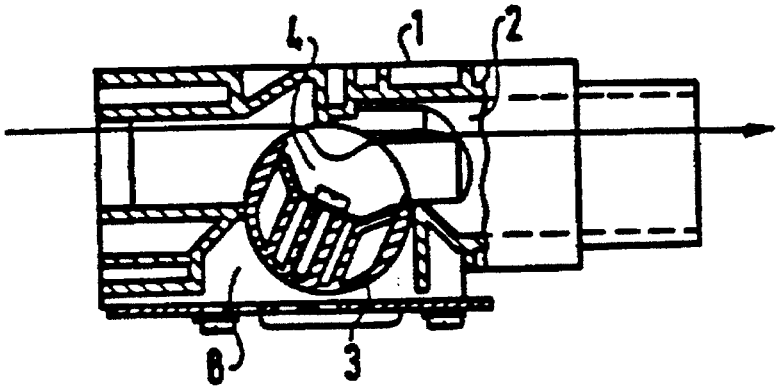

FIG. 3 shows a view of the valve 1 on the side connected to the braking element 10. FIGS. 4A, 4B and 4C show in each case a sectional picture along the line marked. In essence, the valve 1 comprises a valve channel 2, of which one end is connected via the blower channel 16 to the blower 17 and of which the other end is flanged on the braking element 10.

The cross section of this valve channel 2 determines the vacuum which can be generated at the gliding surface 23 at constant blower power. By varying this cross section, the vacuum can be correspondingly varied.

The valve channel 2 is penetrated transversely by a rotary piston 3. This is of circular-cylindrical shape and is supported at both ends in the housing of the valve 1 so as to be rotatable about its axis. The part of the rotary piston 3 located in the valve channel has a flat and depression 4 of the piston cross section. If this flat and depression 4 were to be missing, the rotary piston 3 would close the valve channel 2 in an airtight manner.

The rotary piston 3 closes a further valve opening. In the region of the rotary piston 3, the valve 1 has an opening 8 to the environment which proceeds from the valve channel 2 and leads to the outside. By means of the depression and flat 4 in the rotary piston 3, during rotation of the rotary piston 3, the opening 8 to the environment can be opened to the valve channel 2.

FIGS. 4A, 4B and 4C show various rotational positions of the rotary piston 3. In the first rotational position shown in FIG. 4A, the vacuum channels of the preheating saddle 20,21 and of the braking element 10 are connected to the surrounding air via the opening 8 to the environment. This position serves for the functional security of the printing or copying machine in the case of specific operating parameters being present. By way of example, in an operating condition in which reverse transport of the recording substrate against the actual recorder substrate running direction 9 is necessary, the vacuum must be switched off within a few milliseconds. This is possible by means of rotating the rotary piston 3 into position 1. The position of position 1 is also assumed by the rotary piston 3 if the printing or copying machine reaches a paper operation or a paper positioning operation.

In FIG. 4B, a second rotational position of the rotary piston 3 is shown. In this rotational position, all the openings of the valve 1 are disconnected from each other. The rotary piston 3 seals off the valve channel 2 from the vacuum channels 20,21, from the opening 8 to the environment and from the blower 17. This second position illustrates how the size and dimension of the flat and depression in the rotary piston 3 is to be dimensioned. Sucking air out of the opening 8 to the environment is thus effectively prevented.

In FIG. 4C, a third rotational position of the rotary piston 3 is shown. In this third rotational position, the effective cross section of the valve channel is at its largest. In all further rotational positions of the rotary piston 3 located between the second rotational position and the third rotational position, the effective cross-sectional area of the valve channel 2 is increased.

As shown in FIG. 3, the rotary piston 3 is adjusted by means of a motor 6, which is connected to the rotary piston 3 via a coupling 5. A rotation of the motor 6 effects a rotation of the rotary piston 3. In so doing, the effective cross-sectional area of the valve channel 2 is changed. This effective cross-sectional area can have various basic shapes. In the case of using a rectangular first cross section 31 (see FIG. 5), it has been shown that during rotation of the rotary piston 3—beginning at the second position—by approximately 45°—towards the third position—there is no linear dependence between angle of rotation and vacuum generated. This dependence is demonstrated in FIG. 5. Because of this nonlinearity, the setting of the vacuum and the drive of the motor 6 becomes inaccurate and is made more difficult.

Figure 5:
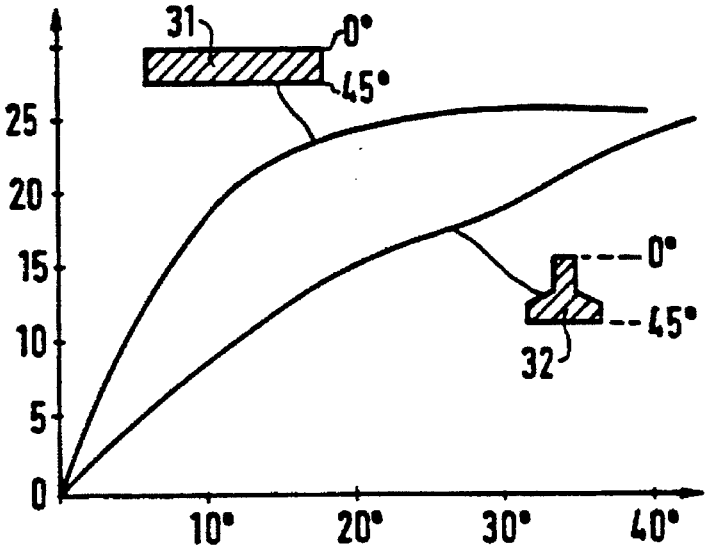
FIG. 5 shows two vacuum/angle of rotation characteristic curves, which occur in the case of valve channel cross-sectional areas of different effectiveness.

A remedy is provided by a second valve channel cross section 32, which is formed in a first angular section by a rectangle standing on its narrow side, in a second angular section by a trapezoid and in a third angular section by a rectangle standing on its broad side. During a rotation of the rotary piston 3, the effective valve channel cross-sectional area 32 continuously increases a little in the first angular section. In the second short angular section, the valve channel cross-sectional area merges continuously into the third angular section having a continuously larger increase of valve channel cross-sectional area. As shown in FIG. 5, the vacuum can thereby be varied virtually linearly with respect to the angle of rotation of the rotary piston 3. A uniformly good meterability of the vacuum and a simplified drive of the motor 6 is thus made possible.

On the side of the rotary piston 3 opposite to the coupling 5, in the vicinity of the periphery, a magnet 7 is fastened to the rotary piston 3. Two position sensors 13,14 are arranged opposite this end of the rotary piston 3. The magnet 7 and a first position sensor coincide in position 1 of the rotary piston 3. A second position sensor 14 and the magnet 7 coincide in position 3 of the rotary piston 3. The position sensors 13,14 are connected via the third input 34 to the converter block 39 of the control unit 25.

By means of these sensors 13,14 it is possible for the control unit 25 to precontrol the printing or copying operation into specific basic positions. There are operational conditions in which control of the vacuum is not possible. In standby operation, the vacuum must be reduced, since the paper web otherwise bulges and the vacuum collapses due to the leakage air. Therefore, the control unit 25 stores the last control position by measuring the time until the rotary piston 3 has moved out of the last control position into the first position and then, at the time of the next printing start, moves for the same time in the other direction and remains in this last control position, once more assumed, initially without controlling. In the case of continuous operation, the control is started once more.

In start-stop operation, the control time available is too short. Until a constant pressure has been built up, the device will possibly already switch back into the stop mode. For this reason, the rotary piston 3 in this mode of operation is likewise always controlled into a position which is in turn defined via a specific switch-on time of the motor 6. Control is not carried out until after about 2 seconds of printing operation.

The second sensor 14 for the third rotational position of the rotary piston 3 is used for monitoring a dust filter 33. The dust filter 33 is located on the blowing side of the blower 17 and prevents suctioned paper dust getting into the environment. The fuller the filter 33 is, the further must the effective valve channel cross-sectional area be increased, in order to achieve the necessary pressure. If the rotary piston 3 moves into the third position, a filter exchange is requested by means of a display on the printing or copying machine.

It should be understood that various changes and modifications to the presently preferred embodiments will be apparent to those skilled in the art. Such changes and modifications may be made without changing the spirit and scope of the present invention, and without diminishing its attendant advantages. Therefore, such changes and modifications are intended to be covered by the appended claims.

What is claimed is:

1. A pneumatic braking device for a recording substrate in an electrographic imaging machine, the braking device comprising:

a braking element which has a braking gliding surface accepting the recording substrate and having at least one suction opening;

a guiding saddle of a fixing device, arranged downstream of the braking element in a running direction of the recording substrate, the guiding saddle having a saddle gliding surface accepting the recording substrate, the saddle gliding surface having at least one suction opening;

a vacuum-generating device in communication with each suction opening; and a valve, the valve including a valve channel and a rotary piston arranged in the valve channel, rotation of the rotary piston varying an effective valve channel cross-sectional area of the valve channel, the rotary piston having a cross-sectional shape such that during rotation of the rotary piston the vacuum is changed approximately linearly with respect to the angle of rotation.

2. The pneumatic braking device as claimed in claim 1, further comprising:

an arrangement to drive the valve with a predetermined piston rotation corresponding to at least one selected operating parameter of the recording substrate and drives the valve (1) as a function thereof.

3. The pneumatic braking device as claimed in claim 2, wherein the arrangement for setting the vacuum includes:

a parameter acquisition unit;

a motor operably coupled to drive the rotary piston;

a plurality of position sensors each being arranged to sense one rotational position of the rotary piston; and a control unit (25), which is operable with the arrangement to drive the valve, the control unit controls the motor causing an effective valve channel cross-sectional opening such that a desired vacuum level is set.

4. The pneumatic braking device as claimed in claim 2 wherein the operating parameter corresponds to a selected operating condition of the imaging machine.

5. The pneumatic braking device as claimed in claim 2 wherein the operating parameter corresponds to a characteristic of the recording substrate.

6. The pneumatic braking device as claimed in claim 5, further comprising:

a pressure sensor which determines the amount of vacuum between the valve and the suction openings, the pressure sensor sending a signal to the control unit.

7. The pneumatic braking device as claimed in claim 1, wherein the cross-section of the rotary piston has at least one flat and depression and wherein the cross section of the valve channel in the region of the rotary piston is shaped such that, rotation of the rotary piston causes the effective valve channel cross-sectional area to have:

in a first angular section, the shape of a rectangle standing on its narrow side;

in a second angular section, the shape of a trapezoid; and in a third angular section, the form of a rectangle standing on its broad side.

8. The pneumatic braking device as claimed in claim 1, wherein:

the valve channel has in the region of the rotary piston an opening to the environment;

the rotary piston is rotatable from a first rotational position, in which the valve channel is open only to the environment and to the suction openings, to a third rotational position, in which the valve channel is closed to the environment and is open from the suction openings to the vacuum-generating device with a maximum effective valve channel cross-sectional area.

9. The pneumatic braking device as claimed in claim 1, wherein the gliding saddle has a plurality of heating zones with temperature increasing in the recording substrate running direction;

wherein the saddle gliding surface is convexly curved in the recording substrate running direction; and wherein, at least one vacuum channel is disposed on a side of the preheating saddle opposite the saddle gliding surface, each vacuum channel having a multiplicity of suction openings opening to the saddle gliding surface, each channel generally running in the recording substrate running direction.

10. The pneumatic braking device as claimed in claim 9, in which the suction openings open in slot-shaped depressions in the saddle gliding surface which extend transversely to the recording substrate running direction.

11. The pneumatic braking device as claimed in claim 9, wherein the valve is directly coupled to the braking element and the vacuum channels are coupled indirectly to the valve via the braking element (10).

12. The pneumatic braking device as claimed in claim 11, wherein the braking element includes:

a matching device for matching its effective width to a width of the recording substrate, wherein at least one vacuum channel is closeable in response to the matching device.

13. The device as claimed in claim 1, wherein the vacuum-generating device includes an air filter.

14. A pneumatic braking device for a stopping a sheet recording medium which is transportable in a running direction in an electrographic imaging machine, the braking device comprising:

a braking element having a braking gliding surface along which the recording substrate is transported, the braking gliding surface having at least one suction opening;

a preheating saddle arranged downstream of the braking element relative to the running direction, the preheating saddle having a saddle gliding surface along which the recording substrate is transportable, the saddle gliding surface having at least one suction opening;

a vacuum-generating device causing a vacuum pressure into each said suction opening; and a valve controlling communication between the vacuum-generating device and the openings, the valve in including a rotatable piston disposed in a valve channel, rotation of the piston varying a degree of vacuum pressure at the suction openings as generally a linear function of an angle of piston rotation.

15. The pneumatic braking device as claimed in claim 14, further comprising:

a motor to rotate the valve piston; and a control unit which controls the motor, such that a sheet recording medium is caused to stop at a predetermined position on the gliding surfaces.

16. The pneumatic braking device as claimed in claim 15, wherein the control unit provides a predetermined angle of rotation corresponding to a selected parameter.

17. The pneumatic braking device as claimed in claim 14, further comprising:

an channel opening from the valve channel to environment, wherein the piston is rotatable from a first rotational position in which the valve channel is in communication with the channel opening and the suction openings, to a third rotational position in which the valve channel is in communication with only with the suction openings, the third position providing maximum vacuum through the suction openings.

18. The pneumatic braking device as claimed in claim 14, further comprising:

a plurality of elongated heating zones on the preheating saddle to heat the recording medium, wherein the saddle gliding surface is convexly curved toward the recording medium;

at least one vacuum channel disposed along preheating saddle opposite the gliding surface, the vacuum channel having a multiplicity of suction openings opening to the saddle gliding surface.

19. The pneumatic braking device as claimed in claim 18, further comprising:

slot-shaped depressions in the saddle gliding surface extending transversely to the recording substrate running direction, the suction openings being disposed therein.

20. The pneumatic braking device as claimed in claim 19, further comprising:

a matching device sensing a width of the recording substrate, the matching device causing at least one vacuum channel to be closed so that the suction openings in communication with vacuum pressure are those within a width of the recording substrate.

* * * * *